US005139262A

United States Patent [19]

Lai

[11] Patent Number: 5,139,262

[45] Date of Patent: Aug. 18, 1992

[54] GOLF PUTTING PRACTICE TARGET

[76] Inventor: Winston Lai, c/o Hung Hsing Patent Service Center, P.O. Box 55-1670, Taipei (10477), Taiwan

[21] Appl. No.: 633,042

[22] Filed: Dec. 24, 1990

[51] Int. Cl.[5] ..... A63B 69/36

[52] U.S. Cl. ..... 273/179 C

[58] Field of Search ..... 273/179 R, 179 C, 179 E, 273/181 A, 181 F, 176 H, 181 K, 182 R, 182 A, 35 B, 180, 181 R, 180

[56] References Cited

U.S. PATENT DOCUMENTS

| | | | |
|---|---|---|---|
| 1,558,766 | 10/1925 | Smith | 273/179 R |
| 1,689,476 | 10/1928 | Brumder | 273/179 A |
| 1,784,863 | 12/1930 | Busse | 273/179 C |
| 2,043,273 | 6/1936 | Watson | 273/181 A |
| 2,443,759 | 6/1948 | Anderson | 273/179 A |
| 2,917,312 | 12/1959 | Brown | 273/179 B |
| 3,156,471 | 11/1964 | Bibeau | 273/182 R |
| 3,264,000 | 8/1966 | Brown | 273/179 R |
| 3,275,325 | 9/1966 | MacKenzie | 273/179 C |
| 3,351,345 | 11/1967 | Robinette | 273/179 R |
| 4,573,686 | 3/1986 | Nakamats | 273/179 C |
| 4,725,063 | 2/1988 | Hoyt, Jr. | 273/179 C |

FOREIGN PATENT DOCUMENTS

| | | | |
|---|---|---|---|
| 2147814 | 5/1985 | United Kingdom | 273/179 C |

*Primary Examiner*—Theatrice Brown

[57] ABSTRACT

An apparatus for practicing a golf stroke includes a sloping board laid on a floor for practing a putting stroke on the slopping board, of which a sloping surface formed on the board can be optionally adjusted to simulate a real sloping surface found in an actual golf course, thereby enhancing a player's putting skill.

5 Claims, 2 Drawing Sheets

GOLF PUTTING PRACTICE TARGET

BACKGROUND OF THE INVENTION

James W. Boswell disclosed a game apparatus in his U.S. Pat. No. 4,395,042 having a structure which supports three separate gaming levels facing a player for use in competitive entertainment and for developing the player's chipping and pitching golf stroke wherein the player stands in front of the apparatus for stroking the ball to penetrate a selected aperture in a target on any gaming level for determining the player's score.

However, such a conventional game apparatus has the following drawbacks:

1. In order to build such a gigantic structure of three levels of target means, it may increase the player's working load, inconvenience and installation cost.

2. It is suitable for practicing a golf chipping and pitching shot, but not suitable for practicing a putting skill since its target means is designed for catching a lofted ball, not adapted for a rolling stroke of a golf ball.

3. The target means is a fixed type, not adjustable, so that it is not suitable for practicing a golf stroke for simulating many a condition encountered in a true golf course.

The present inventor has found the drawbacks of such a conventional game apparatus and invented the present apparatus for practicing the hitting of a golf ball.

SUMMARY OF THE INVENTION

The object of the present invention is to provide an apparatus for practicing a golf stroke including a sloping board laid on a floor so as for practicing a putting stroke on the sloping board.

DETAILED DESCRIPTION

Figure 1:
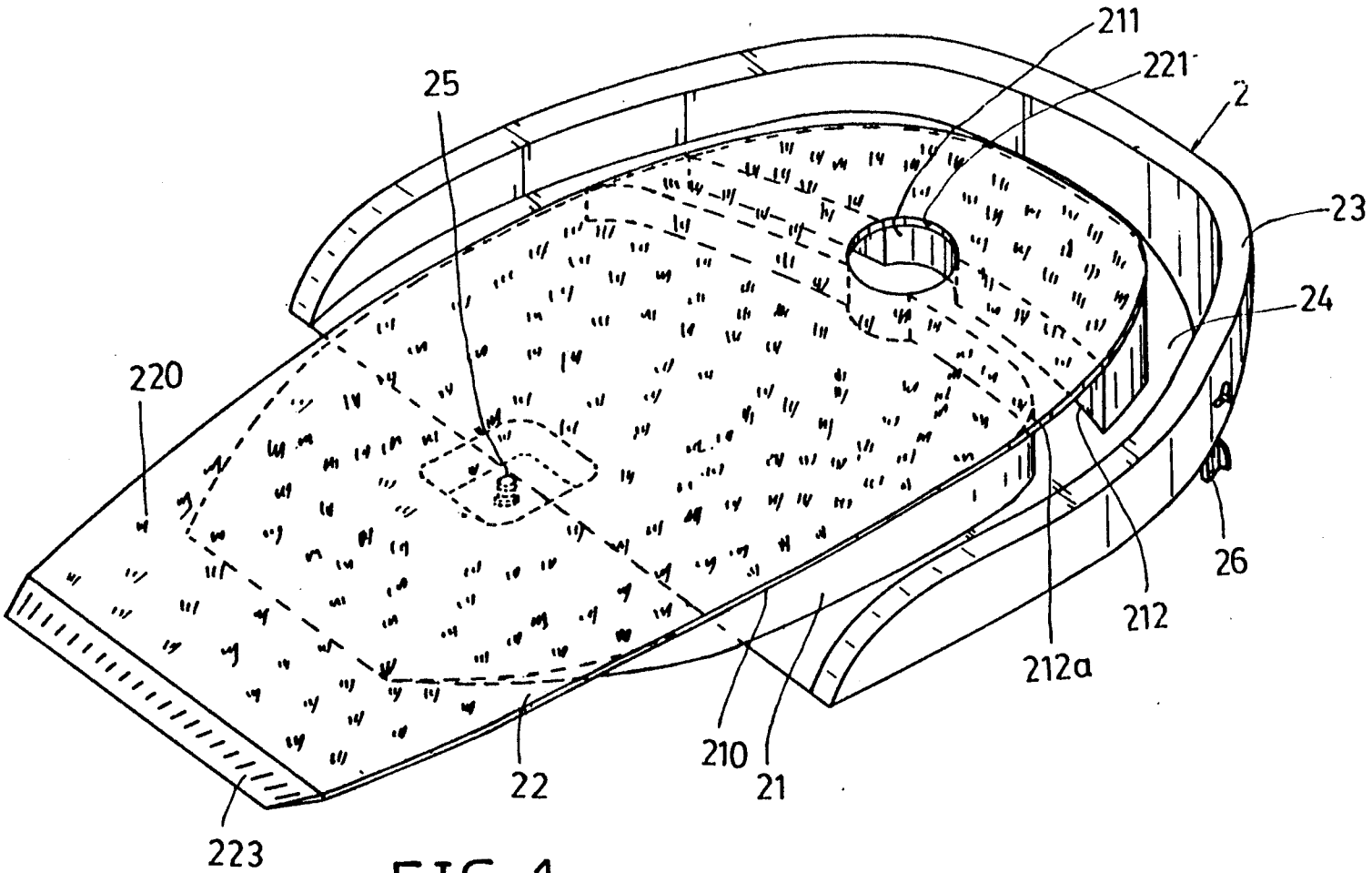
FIG. 1 is an illustration of a sloping board of the present invention.

A sloping board 2 of the present invention comprises: a sloping base 21 having an upper surface 210 sloping downwardly frontwardly to face a player G, a surface mat 22 planted with artificial grass 220 thereon secured on the upper surface 210 of the sloping base 21, a fencing wall 23 formed on and disposed around a rear portion of the base 21 defining a U-shaped sloping channel 24 in between the fencing wall 23 and the base 21 for slopingly returning a golf ball B dropped into the channel 24 towards a player, a fixing bolt 25 for detachably fixing the surface mat 22 on the base 21, and two inclination adjusters 26 respectively formed on two rear side portions (a right and a left side) of the board 2.

The sloping base 21 is formed with a ball hole 211 on a rear upper portion of the base 21 communicated and matched with an upper ball hole 221 formed in a front end portion of the surface mat 22, a lateral sloping tunnel 212 laterally formed in the base 21 respectively communicated with the ball hole 211 and the U-shaped sloping channel 24 having two enlarged arcuate ports 212*a* formed on two side portions of the tunnel 212*a* for an easy rolling of a golf ball from the tunnel 212 to the sloping channel 24 towards a player.

Figure 2:
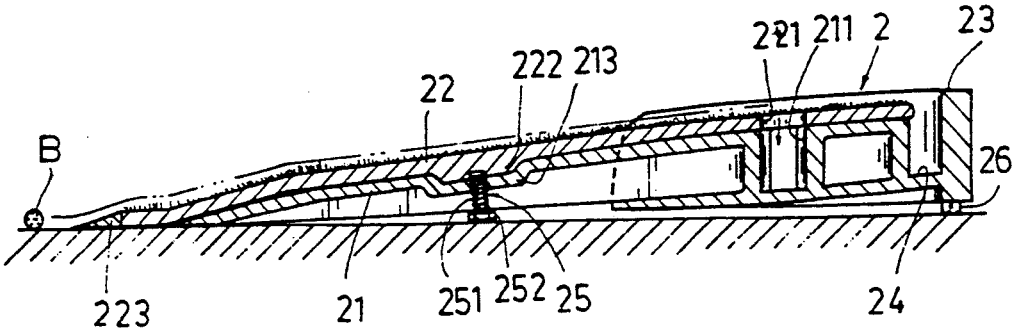
FIG. 2 is a side-view sectional drawing of the sloping board of the present invention.
Figure 3:
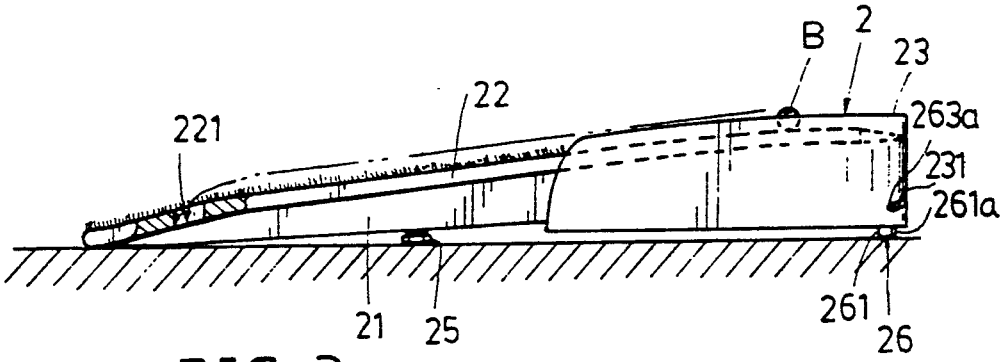
FIG. 3 shows the sloping board with another arrangement of the present invention.

As shown in FIG. 2, the surface mat 22 is formed with a bottom extension 222 engageable with a recess portions 213 formed in the base 21 having the fixing bolt 25 rotatably secured in the recess portion 213 insertable into the bottom extension 222 of the mat 22 for combining the mat 22 on the base 21 by a spring 25 disposed on the bolt and a nut 252 retained on a lower end of the bolt. By the way, the bolt 25 can be released by removing the nut 252 and by rotating the mat 22 about the bolt 25 from FIG. 2 to FIG. 3 to change the ball hole 221 from an upper portion (FIG. 2) to a lower portion for practicing a putting stroke either rolling upwardly (FIG. 2) or downwardly (FIG. 3).

The surface mat 22 includes a front access edge portion 223 made of rubber material for anti-slipping purpose and for a smooth entrance or releasing of a golf ball.

Figure 4:
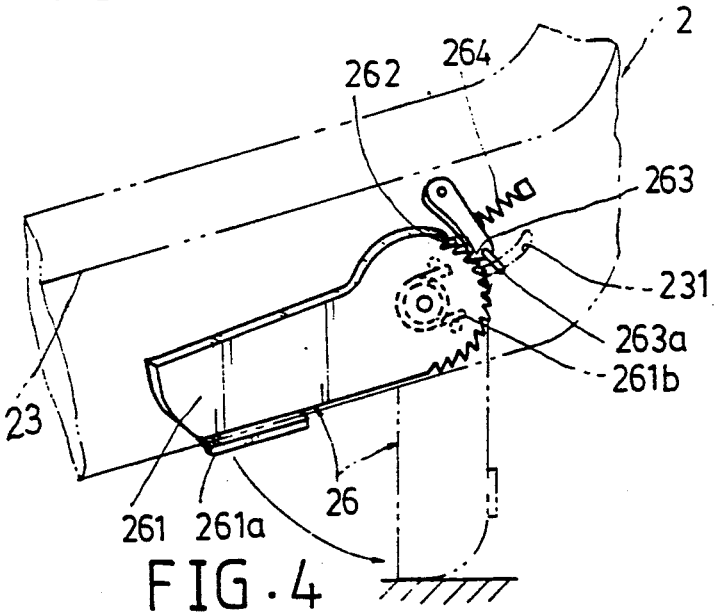
FIG. 4 shows an inclination adjuster for the sloping board of the present invention.

Each inclination adjuster 26 as shown in FIG. 4 includes: a supporting leg 261 pivotally resiliently mounted on a rear side portion of the board 2 preferably formed in a hollow wall 23 by a restoring spring 261*b* having a protrusion 261*a* protruding sidewardly from a bottom edge of the board wall 23 which protrusion 261*a* may serve as a handle for rotating the leg 261 for adjusting the height or inclination of the board 2, a plurality of ratchet teeth 262 tapered clockwise towards a floor formed on a rear portion of the leg 261, a pawl 263 engageable with the rachet teeth 262 allowing a rotation of the leg towards the floor surface F and locking the ratchet teeth 262 to prevent a counter rotation of the leg 261 to retract into a hollow wall 23. The pawl 263 is urged by a spring 264 to engage the teeth 262 and formed with a releasing rod 263*a* protruding outwardly from the pawl 263 through an arcuate slot 231 formed in the wall 23 so that upon a pulling of the rod 263*a* to disengage the pawl 263 from the teeth 262, the leg 261 will be restored by the spring 261*b* to retract into the hollow wall 23 to reduce the height of the board. The spring 261*b* and spring 264 may be integrally combined to be a single spring (not shown). Since two inclination adjusters 26 are formed on a right side and a left side of the board 2, either side adjuster 26 can be optionally operated to adjust a sloping surface of the board 2 either sloping rightwardly or leftwardly to simulate a sloping surface as found in an actual golf course, thereby enhancing a player's skill, such as for practicing a sliced line or a hooked line tracked by the ball, and for vividly feeling the playing of a curved line.

In using the present invention, a short putting can be practiced by stroking the ball B to roll on the board 2 until rolling into the hole 221, 221 in the board 2.

The present invention is superior to a conventional golf game with a vivid imitation or simulation of a golf course for an efficient practice of a putting of a golf ball.

What is claimed is:

1. A practice apparatus for hitting a golf ball comprising:

a sloping board laid on a floor surface including a sloping base having an upper surface sloping downwardly and frontwardly towards a player and having a ball hole formed in an upper rear portion of the base, a surface mat releasably mounted on said sloping base and having an upper ball hole formed in a rear portion thereof, said ball hole in said mat being in matching communication with said ball hole in said sloping base, a fencing wall formed on rear and side portions of said sloping base and defining a U-shaped sloping channel between said fencing wall and said sloping base for gravitationally rolling a golf ball frontwardly towards a player in said channel, said ball hole of said sloping base having a lateral sloping tunnel communicated with a ball hole and said U-shaped sloping channel for causing a ball entering said hole to gravitationally roll from said ball hole downwardly into said lateral sloping tunnel and into said U-shaped sloping channel, said surface mat being releasably attached by a fixing bolt secured to said sloping base whereby said surface mat can be repositioned to change said upper ball hole either on an upper portion or a lower portion of said base for practice putting to cause a ball to roll on an upward or a downward sloping surface.

2. A practice apparatus according to claim 8, wherein said surface mat is formed with a bottom extension on a central bottom portion thereof and engageable with a recess portion formed in the sloping base, said fixing bolt being rotatably secured in the recess portion of said sloping base and being insertable into the bottom extension of the surface mat for releasably attaching the mat on the sloping base, a spring being disposed on the fixing bolt and a nut retained on a lower end of the fixing bolt.

3. A practice apparatus according to claim 1, wherein said sloping board includes two inclination adjusters respectively attached to a rear right side portion and a rear left side portion of said board for adjusting the inclination of said board either sloping rightwardly or leftwardly.

4. A practice apparatus according to claim 3, wherein each said inclination adjuster includes: a supporting leg pivotally mounted at one of its ends to a rear side portion of the sloping board, a restoring spring for biasing said leg in a predetermined direction, a protrusion attached to the other end of said leg and protruding sidewardly from a bottom edge of the fencing wall of said board, said protrusion serving as a handle for manual pivoting of the leg for adjusting the height or inclination of the board, a plurality of ratchet teeth tapered towards a board support surface and formed on a rear portion of said one end of said leg, a pawl resiliently engageable with the ratchet teeth for allowing manual pivoting of the leg towards the board support surface and for locking the ratchet teeth to prevent a counter rotation of the leg, a recess formed in each side of said fencing wall for receiving a respective pivoted leg.

5. A practice apparatus according to claim 4, wherein said pawl is urged by a spring to engage the ratchet teeth, a releasing rod protruding outwardly from the pawl through an arcuate wall slot formed in the fencing wall, the releasing rod being manually pulled to disengage the pawl from the ratchet teeth so as to retract the leg into said recess.

* * * * *